US007896672B2

(12) United States Patent
Felisilda De La Cruz

(10) Patent No.: US 7,896,672 B2
(45) Date of Patent: Mar. 1, 2011

(54) EMI SUPPRESSION FOR ELECTRICAL CONNECTOR

(75) Inventor: Robert Steven Felisilda De La Cruz, Reno, NV (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/510,354

(22) Filed: Jul. 28, 2009

(65) Prior Publication Data

US 2011/0028037 A1 Feb. 3, 2011

(51) Int. Cl.
*H01R 29/00* (2006.01)

(52) U.S. Cl. ..... 439/188; 200/51.1; 439/620.17

(58) Field of Classification Search ..... 439/188, 439/51.1, 620.17, 620.18, 620.23, 607.28
See application file for complete search history.

(56) References Cited

U.S. PATENT DOCUMENTS 6,065,985 A 5/2000 Marshall
6,099,334 A 8/2000 Togashi
6,162,076 A 12/2000 Francaviglia
6,676,423 B1 1/2004 Marowsky et al.
6,736,680 B2 5/2004 Slack et al.
6,780,035 B2 * 8/2004 Bohbot ..... 439/188
6,793,510 B2 * 9/2004 Yamakawa et al. ..... 439/188
6,840,817 B2 1/2005 Chen
7,029,285 B2 * 4/2006 Abe ..... 439/62
7,179,131 B2 * 2/2007 Caveney et al. ..... 439/676
7,686,650 B2 * 3/2010 Belopolsky et al. .... 439/620.17

* cited by examiner

*Primary Examiner*—Michael C Zarroli

(57) ABSTRACT

An electrical connector includes a housing having a cavity configured to receive a plug therein. Contacts are arranged within the cavity for mating with a plug. The contacts include shield interfaces. A metal strip is arranged within the cavity and is electrically connected to a ground. The shield interfaces of the contacts engaging the metal strip when no plug is loaded in the cavity, and the shield interfaces disengaging from the metal strip when the plug is loaded in the cavity.

19 Claims, 4 Drawing Sheets

EMI SUPPRESSION FOR ELECTRICAL CONNECTOR

BACKGROUND OF THE INVENTION

The subject matter herein relates generally to electrical connectors, and more particularly, to EMI suppression for electrical connectors.

Electrical connectors such as Ethernet connectors, RJ connectors and the like are commonly used as the interface between data cables and networking and telecommunications equipment. Typically, a jack connector is associated with the equipment and a plug connector is provided at an end of a cable and is mated with the jack connector. High-speed digital signals entering and/or leaving the system by means of these connectors and their associated cables are prone to having Electromagnetic Interference (EMI) problems at, the interface of the connectors. The EMI problems are more noticeable at higher transmission speeds. As Ethernet connectors are pushing higher speeds; such as 10 Gbps, the connectors radiate noise causing the EMI problems. At high speeds, the radiated noise is even a problem when the connectors are unmated. For example, the contacts within the jack connector may act as antennas and cause the EMI problems to be exacerbated. For example, the jack connectors are typically arranged as an array within the equipment in close proximity to other jack connectors. EMI caused by one jack connector interferes with the performance of adjacent jack connectors.

Accordingly, there remains a need for jack connectors which reduce EMI problems. There remains a need for jack connectors that reduce the potential for the contacts within the jack connector to act as antennas.

BRIEF DESCRIPTION OF THE INVENTION

In one embodiment, an electrical connector is provided including a housing having a cavity configured to receive a plug therein. Contacts are arranged within the cavity for mating with a plug. The contacts include shield interfaces. A metal strip is arranged within the cavity and is electrically connected to a ground. The shield interfaces of the contacts engaging the metal strip when no plug is loaded in the cavity, and the shield interfaces disengaging from the metal strip when the plug is loaded in the cavity.

In another embodiment, an electrical connector is provided including a housing and contacts arranged within the housing. The contacts are deflected when mated with a plug from a relaxed state to a deflected state. A grounded metal strip is positioned within the housing. The contacts engage the metal strip when the contacts are in the relaxed state.

In a further embodiment, an electrical connector is provided that includes a housing having a cavity configured to receive a plug therein. A circuit board is held within the housing that is electrically connected to a ground. Contacts are arranged within a cavity for mating with a plug. The contacts are terminated to the circuit board. A metal strip is arranged within the cavity that is electrically connected to the circuit board. The metal strip is connected to the ground via the electrical connection with the circuit board. The contacts are configured to engage the metal strip when no plug is loaded in the cavity, and the contacts are configured to be held away from the metal strip by the plug when the plug is loaded in the cavity.

DETAILED DESCRIPTION OF THE INVENTION

Figure 1:
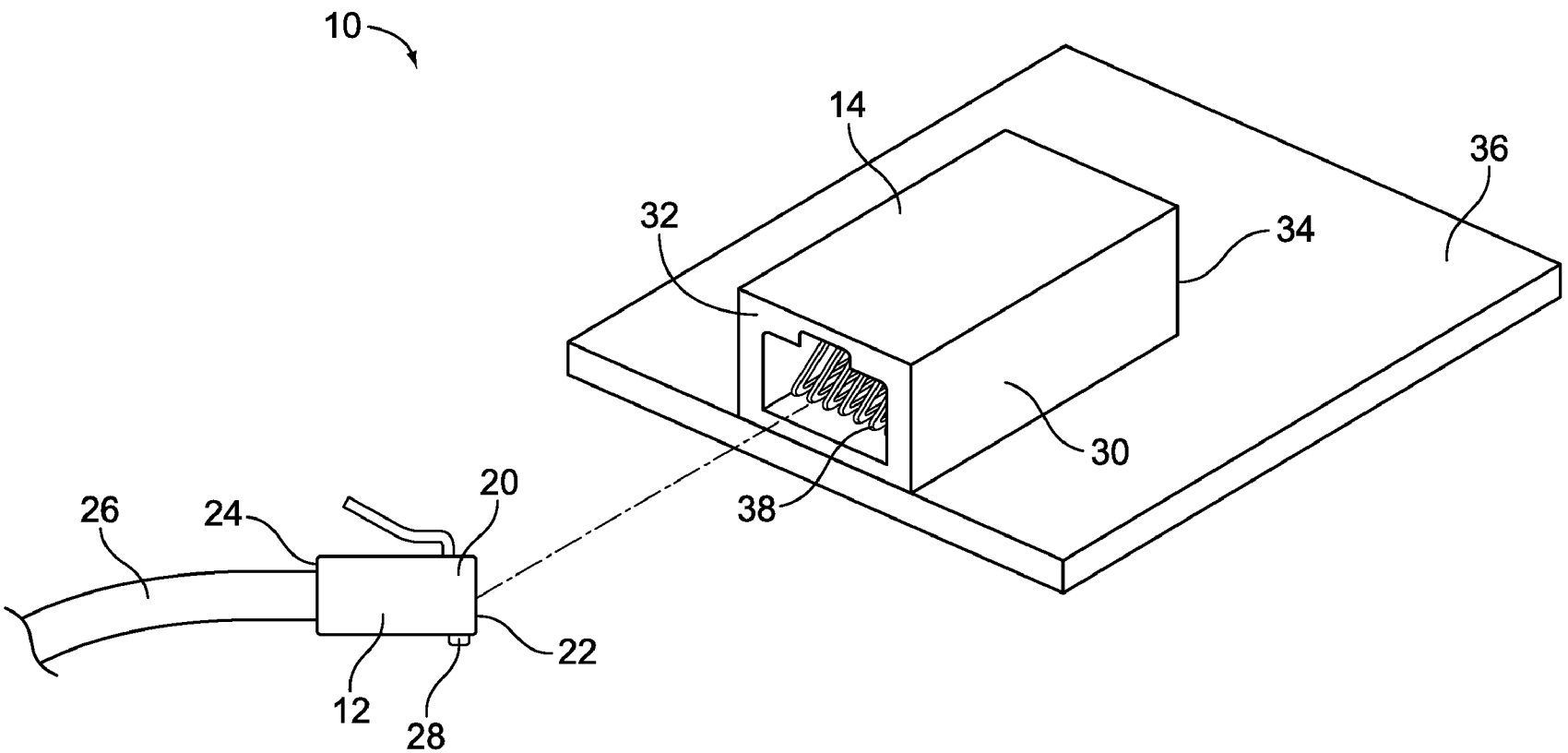
FIG. 1 illustrates a connector system having a plug and a jack.

FIG. 1 illustrates a connector system 10 having a plug 12 and a jack 14. The connector system 10 represents a data communication system having electrical connectors defining a mating interface between a cable and a circuit board, or alternatively, between different cables. The plug 12 constitutes a first electrical connector and the jack 14 constitutes a second electrical connector. The plug 12 and the jack 14 are used to transmit data within the connector system 10. Optionally, power may be transmitted by the cables and across the mating interface of the plug 12 and the jack 14. For example, the connector system 10 may constitute a power-over-Ethernet (POE) system with the plug 12 and the jack 14 representing Ethernet connectors configured to transmit power therebetween.

The plug 12 includes a housing 20 extending between a mating end 22 and a terminating end 24. The terminating end 24 is connected to an end of a cable 26. The plug 12 includes a plurality of plug contacts 28 at the mating end 22.

The jack 14 includes a housing 30 extending between a mating end 32 and a terminating end 34. The terminating end 34 is connected to a circuit board 36, such as a host board, a panel, a network switch, or another electrical component. Alternatively, the terminating end 34 may be connected to an end of a cable in a similar manner as the plug 12. The jack 14 includes a plurality of jack contacts 38 at the mating end 22.

Figure 2:
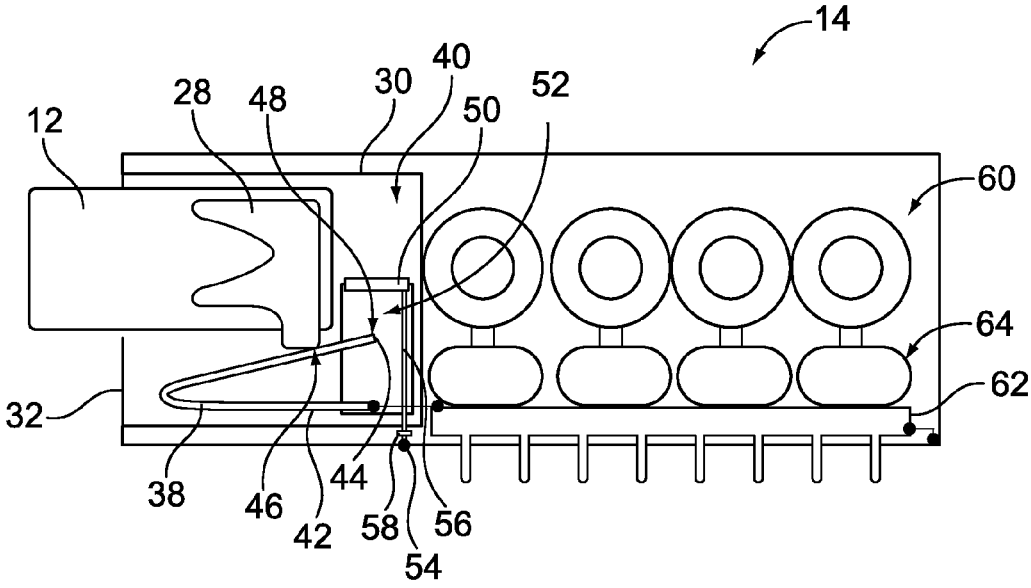
FIG. 2 is a cross-sectional view of the plug mated with the jack.

FIG. 2 is a cross-sectional view of the plug 12 mated with the jack 14. The housing 30 of the jack 14 includes a cavity 40 that receives the plug 12 therein. The cavity 40 is open at the mating end 32. The jack contacts 38 are arranged within the cavity 40 for mating with the plug contacts 28. In an exemplary embodiment, the jack contacts 38 are spring type contacts that are deflectable between a relaxed state (shown in FIG. 3) and a deflected state (shown in FIG. 2). The plug 12 is configured to deflect the jack contacts 38 from the relaxed state to the deflected state when the plug 12 is loaded in the cavity 40. The jack contacts 38 are biased against the plug contacts 28 when the jack contacts 38 are in the deflected state.

Each jack contact 38 includes a base 42 and a tip 44 generally opposite the base 42. The base 42 may be generally fixed in position within the housing 30. The tip 44 is deflected when the jack contact 38 is mated with the plug 12. The jack contact 38 has a mating interface 46, which is the portion of the jack contact 30 that mates with the corresponding plug contact 28. A portion of the jack contact 38 is folded over and suspended diagonally toward the tip 44 from the base 42. The mating interface 46 is arranged along the diagonally suspended portion of the jack contact 38. The jack contact 38 has a shield interface 48 proximate to the tip 44. Optionally, the shield interface 48 may be defined at the tip 44.

The jack 14 includes a grounded metal strip 50 arranged within the cavity 40. The metal strip 50 is aligned with the tips 44 of the jack contacts 38. When the jack contacts 38 are in the deflected state, the jack contacts 38 do not engage the metal strip 50. The jack contacts 38 are held away from the metal strip 50 by the plug 12. A gap 52 is created between the jack contacts 38 and the metal strip 50 when the jack contacts 38 are in the deflected state. The metal strip 50 is electrically connected to a ground 54 by a ground path 56, which are represented schematically in FIG. 2. The ground path forms part of a grounding circuit. The grounding circuit electrically connects the metal strip 50 to the ground 54. The ground 54 may be chassis ground, earth ground or any preferred ground. The metal strip 50 may be directly connected to the ground 54. Alternatively, the metal strip 50 may be indirectly connected to the ground 54, such as by a wire or a conductor extending between the ground 54 and the metal strip 50. In the illustrated embodiment, a capacitor 58 is provided within the ground path 56 between the metal strip 50 and the ground 54. Other electrical components may form part of the ground path 56 in addition to, or alternatively to, the capacitor 58. In an exemplary embodiment, the jack 14 may represent a POE electrical connector configured to transmit power across the interface of the jack 14. The capacitor 58 prevents power from being tied to the ground 54 and/or eliminates the possibility of shorting the connector.

The jack 14 includes a magnetics assembly 60 held within the housing 30. The magnetics assembly 60 includes a circuit board 62 and sets of magnetics 64 connected to the circuit board 62. The magnetics 64 may include a choke, a transformer, and/or other electrical components. The magnetics assembly 60 provides isolation and/or a reduction in noise for the signals transmitted through the jack 14. The circuit board 62 may be mounted to the host board 36 (shown in FIG. 1) or another electrical component. Such a configuration defines a board mounted jack. Alternatively, the circuit board 62 may be electrically connected to wires from a cable. Such a configuration defines a cable mounted jack.

Optionally, the circuit board 62 may be grounded to chassis ground, earth ground, or any preferred ground. The ground 54 may be commoned with the grounded circuit board 62. The metal strip 50 may be electrically connected to the circuit board 62 to ground the metal strip 50. Alternatively, the ground 54 may be separate from the circuit board 62. The ground 54 and the circuit board 62 may be grounded to the same component.

The jack contacts 38 are electrically connected to the circuit board 62. For example, the bases 42 of the jack contacts 38 may be directly terminated to the circuit board 62. Alternatively, the jack contacts 38 may be indirectly connected to the circuit board 62, such as by wires, conductors and the like.

Figure 3:
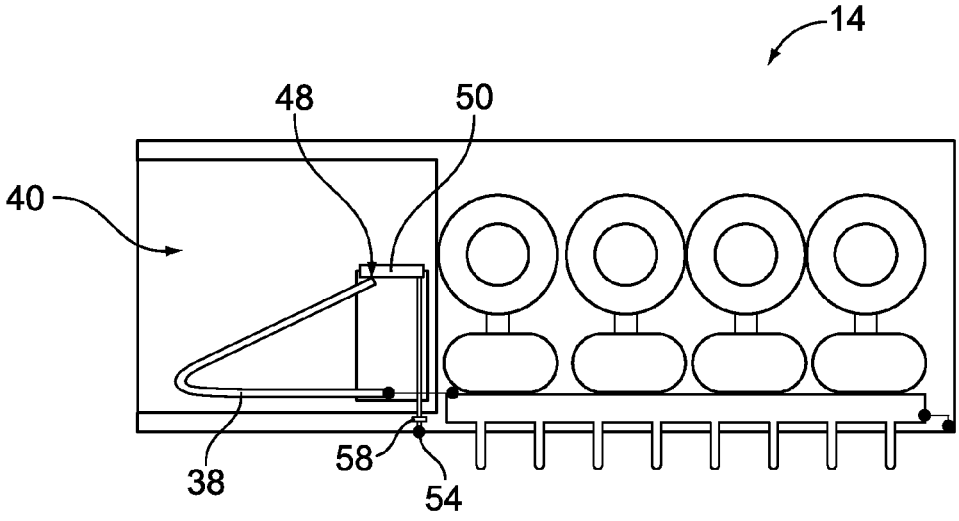
FIG. 3 is a cross-sectional view of the jack without the plug therein.

FIG. 3 is a cross-sectional view of the jack 14 without the plug 12 (shown in FIG. 1) therein. Without the plug 12 in the cavity 40 the jack contacts 38 are in the relaxed state. In the relaxed state, the shield interfaces 48 engage the metal strip 50. When the jack contacts 38 engage the metal strip 50, the jack contacts 38 are connected to the ground 54 through the capacitor 58. The connection to the ground prevents the jack contacts 38 from becoming antennas and/or from being a source of noise and/or electromagnetic interference (EMI) for electrical components in the vicinity of the jack 14. The metal strip 50 effectively ties the jack contacts 38 to the ground 54 to suppress EMI. The capacitor 58 prevents power from being tied to the ground 54 and/or eliminates the possibility of shorting the connector.

Figure 4:
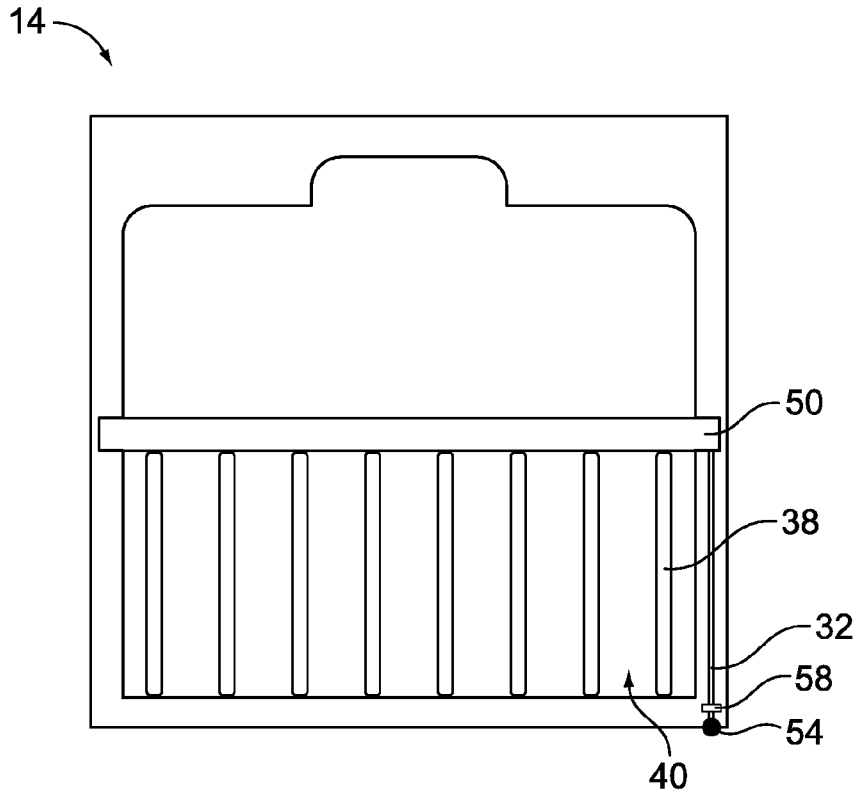
FIG. 4 is a front view of the jack.

FIG. 4 is a front view of the jack 14 illustrating the cavity 40 and the jack contacts 38 arranged within the cavity 40. Eight jack contacts 38 are illustrated in FIG. 4. Any number of jack contacts 38 may be provided in alternative embodiments. In an exemplary embodiment, the jack 14 represents an Ethernet connector. The jack 14 is an eight position eight contact socket. The jack contacts 38 are parallel to one another and equally spaced apart from one another across the mating end 32.

The metal strip 50 is arranged within the cavity 40. The metal strip 50 is positioned such that the shield interfaces 48 (shown in FIG. 3) engage the metal strip 50 when the jack contacts 38 are in the relaxed state. In the illustrated embodiment, the metal strip 50 is approximately centered within the cavity 40. Each of the jack contacts 38 engages the same metal strip 50. As such, the jack contacts 38 are electrically commoned to one another and to the ground 54. The capacitor 58 is provided as part of the grounding circuit between the metal strip 50 and the ground 54. In an alternative embodiment, multiple grounded metal strips may be provided within the cavity 40. Different jack contacts 38 may engage different metal strips. The different metal strips may be offset with respect to one another, such as in a staggered configuration, with different metal strips at different heights from the base of the housing 30 and/or at different depths from the mating end 32. Optionally, only select ones of the metal strips may be connected to the ground 54 through the capacitor 58. Alternatively, all of the metal strips may be connected to the ground 54 through the capacitor 58.

Figure 5:
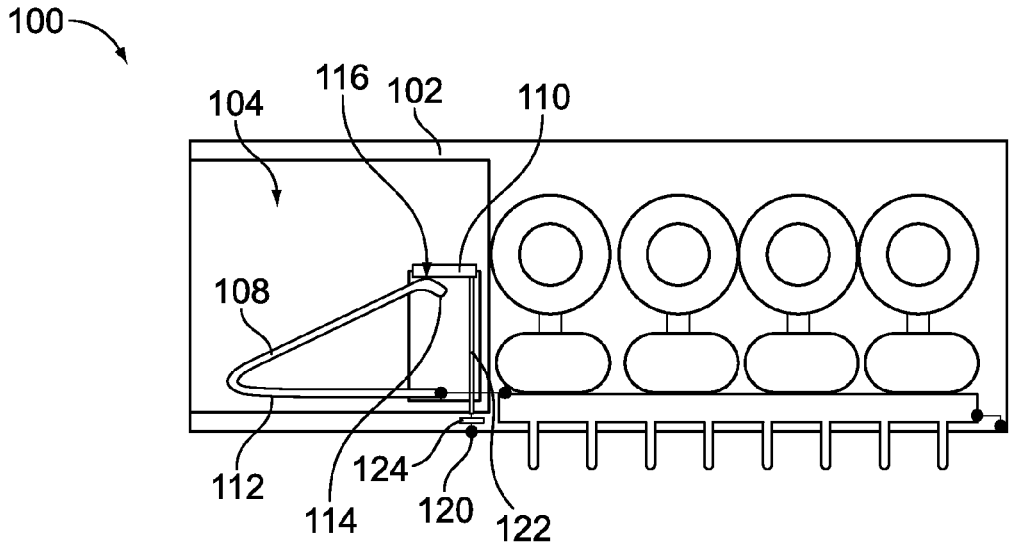
FIG. 5 is a cross-sectional view of an alternative jack.

FIG. 5 is a cross-sectional view of an alternative jack 100. The jack 100 includes a housing 102 having a cavity 104 open at a mating end 106 of the jack 100. The jack 100 includes a plurality of jack contacts 108 within the cavity 104 at the mating end 106. The jack 100 includes a metal strip 110 within the cavity 104.

Each jack contact 108 includes a base 112 and a tip 114. The jack contact 108 has a shield interface 116 proximate to the tip 114. The jack contact 108 may be curved or flat at the shield interface 116 for good contact with the metal strip 110. The jack contact 108 is deflectable from a relaxed state to a deflected state. The jack contact 108 engages the metal strip 110 in the relaxed state. The jack contact 108 is moved to the deflected state when the plug 12 is loaded into the cavity 104. The jack contact 108 does not engage the metal strip 110 when the jack contact 108 is in the deflected state.

The metal strip 110 is electrically connected to a ground 120 by ground path 122, which are represented schematically in FIG. 5. A capacitor 124 is provided within the ground path 122 between the metal strip 110 and the ground 120. Other electrical components may form part of the ground path 122 in addition to, or alternatively to, the capacitor 124. The ground 120 may be chassis ground, earth ground or any preferred ground. In an exemplary embodiment, the jack 100 may represent a POE electrical connector configured to transmit power across the interface of the jack 100. The capacitor 124 prevents power from being tied to the ground 120 and/or eliminates the possibility of shorting the connector.

Figure 6:
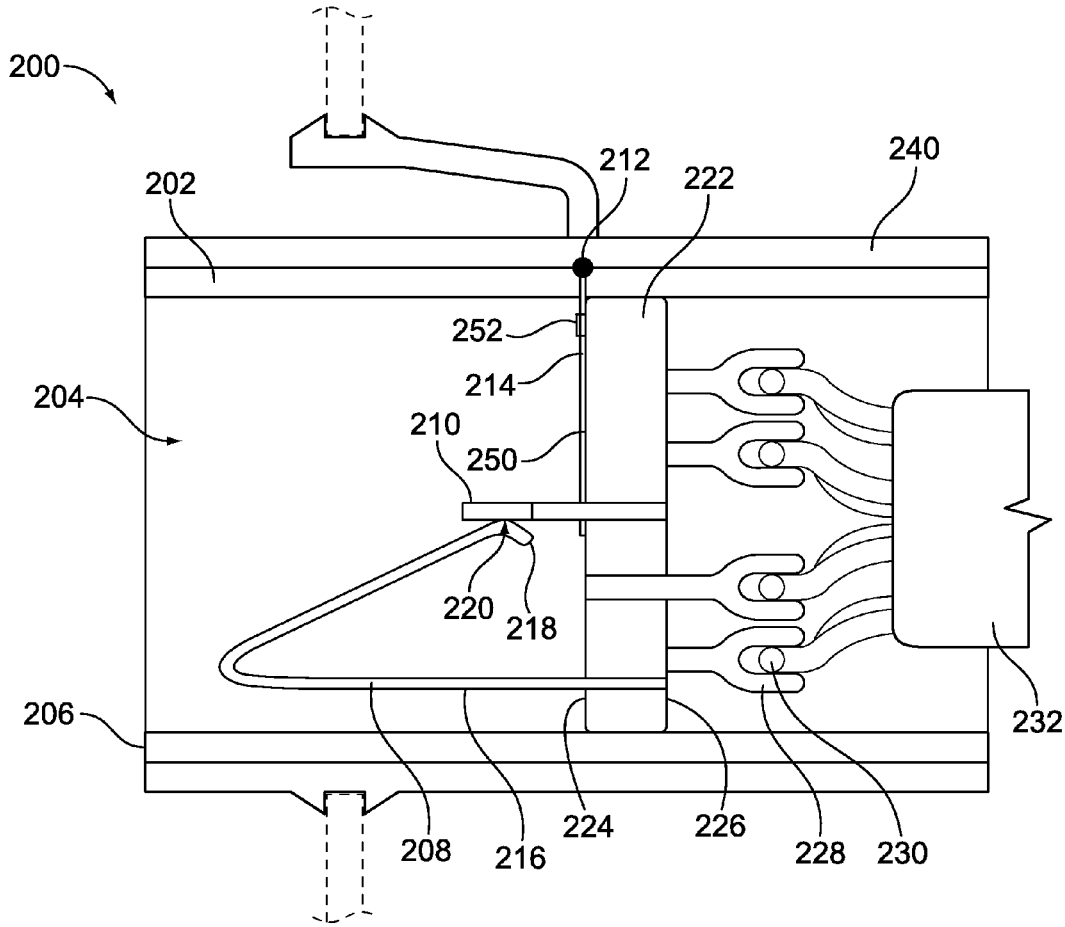
FIG. 6 is a cross-sectional view of another alternative jack.

FIG. 6 is a cross-sectional view of another alternative jack 200. The jack 200 represents an RJ-45 type socket connector. The jack 200 includes a housing 202 having a cavity 204 open at a mating end 206 of the jack 200. The jack 200 includes a plurality of jack contacts 208 within the cavity 204 at the mating end 206. The jack 200 includes a metal strip 210 within the cavity 204. The metal strip 210 is electrically connected to a ground 212 by a ground path 214, which are represented schematically in FIG. 6. The ground path 214 is part of the grounding circuit. In the illustrated embodiment, the ground path 214 is represented by one or more traces 250 on a circuit board 222. A capacitor 252 is coupled to the circuit board 222. The traces 250 are electrically connected to the capacitor 252. The traces 250 are electrically connected to the ground 212.

Each jack contact 208 includes a base 216 and a tip 218. The jack contact 208 has a shield interface 220 proximate to the tip 218. The jack contact 208 is deflectable from a relaxed state to a deflected state. The jack contact 208 engages the metal strip 210 in the relaxed state. The jack contact 208 is moved to the deflected state when the plug 12 is loaded into the cavity 204. The jack contact 208 does not engage the metal strip 210 when the jack contact 208 is in the deflected state.

The jack 200 includes a circuit board 222 arranged within the housing 202. The bases 216 of the jack contacts 208 are connected to the circuit board 222. The circuit board 222 includes a first side 224 and a second side 226. The first side 224 is parallel to and faces the mating end 206. Wire terminating contacts 228 extend from the second side 226. Wires 230 of a cable 232 are terminated to the wire terminating contacts 228. The ground 212 is provided on the circuit board 222. The metal strip 210 is electrically connected to the circuit board 222 and the ground 212 on the circuit board 222.

Optionally, the housing 202 may be shielded. For example, a metal shield 240 may surround the housing 202. Alternatively, the housing 202 may be metalized, such as by a plating process, to shield the housing 202. The metal shield 240 may be grounded, such as when the jack 200 is mounted within a chassis or a panel (shown in phantom). The ground 212 is electrically commoned with the metal shield 240. For example, the circuit board 222 is electrically connected to the metal shield 240 surrounding the housing 202. In an alternative embodiment, the ground 212 may be defined by the housing 202, which may be shielded such as by being metalized. The metal strip 210 may be directly or indirectly connected to the shielded housing 202.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a cavity configured to receive a plug therein, the housing being shielded by a housing shield;

contacts arranged within the cavity for mating with a plug, the contacts including strip interfaces; and a metal strip arranged within the cavity, the metal strip being electrically connected to a ground through a capacitor, the metal strip being electrically connected to the housing shield through the capacitor, the strip interfaces of the contacts engaging the metal strip when no plug is loaded in the cavity, the strip interfaces disengaging from the metal strip when the plug is loaded in the cavity.

2. The electrical connector of claim 1, wherein a grounding circuit is created between the metal strip and the ground, the capacitor being provided within the grounding circuit.

3. The electrical connector of claim 1, wherein at least one of the contacts is configured to transmit power, the capacitor preventing power from shorting to the ground.

4. The electrical connector of claim 1, wherein the electrical connector constitutes a Power Over Ethernet connector, the contacts being configured to transmit data signals and being arranged in differential pairs, at least one of the contacts being configured to transmit power, the capacitor preventing power transmitted by the electrical connector from shorting to the ground.

5. The electrical connector of claim 1, wherein the metal strip electrically connects the contacts to ground when the strip interfaces engage the metal strip.

6. The electrical connector of claim 1, wherein the contacts are movable between a grounded position and an ungrounded position, the contacts engaging the metal strip in the grounded position and the contacts being held away from the metal strip in the ungrounded position.

7. The electrical connector of claim 1, further comprising a circuit board held within the connector, the circuit board being electrically connected to the ground, the capacitor being connected to the circuit board, the metal strip being connected to the ground via the circuit board.

8. The electrical connector of claim 1, further comprising a magnetics assembly having a circuit board, the contacts being terminated to the circuit board.

9. The electrical connector of claim 1, wherein the contacts include a base and a tip, the strip interfaces being positioned proximate to the tip, the base being coupled to one of a circuit board and a wire.

10. An electrical connector comprising:

a housing;

signal contacts arranged within the housing in differential pairs configured to transmit differential signals, the signal contacts being deflected when mated with a modular data communication plug from a relaxed state to a deflected state;

a metal strip positioned within the housing, wherein the signal contacts engage the metal strip when the signal contacts are in the relaxed state; and a grounding circuit being electrically grounded, the grounding circuit having a capacitor, the metal strip being electrically connected to the grounding circuit.

11. The electrical connector of claim 10, wherein at least one of the contacts is configured to transmit power, the capacitor preventing power from shorting to the ground.

12. The electrical connector of claim 10, further comprising a circuit board held within the connector, the grounding circuit having traces routed along the circuit board, the circuit board being electrically connected to the ground, the capacitor being connected to the circuit board, the metal strip being electrically connected to the traces on the circuit board.

13. The electrical connector of claim 10, wherein the metal strip electrically connects the contacts to ground when the contacts engage the metal strip.

14. The electrical connector of claim 10, wherein the contacts are held away from the metal strip by the plug in the deflected state.

15. The electrical connector of claim 10, further comprising a magnetics assembly having a circuit board, the contacts being terminated to the circuit board.

16. The electrical connector of claim 10, wherein the housing is shielded by a housing shield, the metal strip being electrically connected to the housing shield.

17. An electrical connector comprising:

a housing having a cavity configured to receive a plug therein;

a circuit board held within the housing, the circuit board includes a capacitor, the circuit board being electrically connected to a ground through the capacitor on the circuit board;

contacts arranged within the cavity for mating with a plug, the contacts being terminated to the circuit board; and a metal strip arranged within the cavity, the metal strip being electrically connected to the circuit board, the metal strip being connected to the ground via the electrical connection with the circuit board through the capacitor on the circuit board, the contacts being configured to engage the metal strip when no plug is loaded in the cavity, and the contacts being configured to be held away from the metal strip by the plug when the plug is loaded in the cavity.

18. The electrical connector of claim 17, wherein the contacts are movable between a grounded position and an ungrounded position, the contacts engaging the metal strip in the grounded position and the contacts being held away from the metal strip in the ungrounded position.

19. The electrical connector of claim 17, wherein the housing is shielded by a housing shield, the circuit board being electrically connected to the ground through the housing shield, the metal strip being electrically connected to the housing shield through the circuit board and the capacitor on the circuit board.

* * * * *